United States Patent [19]

Isogai et al.

[11] Patent Number: 4,505,397

[45] Date of Patent: Mar. 19, 1985

[54] APPARATUS FOR HOISTING MATERIALS AND PLACING CONCRETE

[75] Inventors: Sakichi Isogai, Urawa; Teruo Mizuhata, Kobe; Masaaki Takahashi, Kishiwada; Takayoshi Imai, Sakai; Kazuyoshi Nakanishi, Kogagun; Takefumi Ito, Kobe; Atsuo Koshihara, Sakai, all of Japan

[73] Assignee: Takenaka Komuten Co., Ltd., Osaka, Japan

[21] Appl. No.: 480,212

[22] Filed: Mar. 30, 1983

[51] Int. Cl.[3] ..... B67D 5/00

[52] U.S. Cl. ..... 212/232; 137/615; 212/251

[58] Field of Search ..... 137/615; 212/232, 251; 285/112; 226/110; 141/279; 417/900

[56] References Cited

U.S. PATENT DOCUMENTS

| | | | |
|---|---|---|---|
| 2,902,177 | 9/1959 | Stoddard | 212/251 |
| 3,249,121 | 5/1966 | Bily | 137/615 |
| 3,459,222 | 8/1969 | McElroy | 137/615 |
| 3,707,990 | 1/1973 | Schiable | 137/615 |
| 3,964,512 | 6/1976 | Dumas | 137/615 |
| 3,976,092 | 8/1976 | Coja | 137/615 |
| 4,109,681 | 8/1978 | Stahl | 137/615 |
| 4,180,170 | 12/1979 | Meinken | 212/1 |

*Primary Examiner*—Sherman D. Basinger
*Attorney, Agent, or Firm*—Sandler & Greenblum

[57] ABSTRACT

An apparatus for hoisting materials and placing concrete, having a non-rotating mast and a boom which is swingable horizontally and vertically, and consists of boom segments pin-jointed together in line so as to be foldable only downwardly. A line of concrete transport piping extends from the base end of the boom to the free end thereof, and a line of hoisting sling extends from the base end of the boom to the free end, hangs down to hold a load handling block, rises up and extends back to the base end, each such line being supported alongside of the boom. In service for hoisting materials, the boom is stretched and fixed at each pin-jointed connection for reinforcement by releasable pin-fastening members, whereas in service for concrete placing, the hoisting sling is raised up and seized in place to avoid interference. The apparatus is remotely controllable.

4 Claims, 14 Drawing Figures

APPARATUS FOR HOISTING MATERIALS AND PLACING CONCRETE

FIELD OF THE INVENTION

This invention relates to an apparatus used for hoisting materials and placing concrete suitable in constructing buildings and the like, in particular, high rise buildings.

PRIOR ART

In the past, the operation of constructing building frames and subsequent concrete placing were conducted by a separate crane and a concrete placer.

U.S. Pat. No. 4,180,170 issued Dec. 25, 1979 to Bernhard Meinken, revealed a crane having a mast and two booms, the first boom being swingable about the mast at the top thereof and serving as a crane, and the second boom being mounted to the mast at a suitable distance below the first and serving as a concrete placer. Such an apparatus can substantially save materials and space, but has the disadvantage that both booms interfere with each other, and has not been so effective as has been expected.

Provided that a boom serves to both hoist materials and place concrete, much more merits can be expected, but, to the best of our knowledge, no such apparatuses have ever appeared in the market.

U.S. Pat. No. 3,459,222 issued Aug. 5, 1969 to Philip W. McElroy, disclosed an apparatus to be mounted on a vehicle having a boom mounted pivotally on a base, consisting of three sections pivotally connected in line, and having a concrete piping alongside thereof, extending from the base and passing through each pivotal connection successively to the free end thereof. The teaching of this patent is instructive, and although no part thereof constitutes the invention, part thereof will be included in the claim of this invention.

SUMMARY OF THE INVENTION

It is a primary object of this invention to provide an apparatus having one boom and one mast, and having dual functions of hoisting materials and placing concrete.

Another object of this invention is to provide an apparatus as above which serves for hoisting materials or placing concrete, alternatively. This is because the boom thereof should have enough mechanical strength against workload when it is serving for hoisting, whereas when used as a concrete placer, the primary concern is quick and close accessibility to the working places.

A further object of this invention is to provide an apparatus as above which enables ready and easy switch-over from one type of the operation to the other.

A still further object of this invention is to provide an apparatus as above whose sling for hoisting materials is kept completely free of slack and kept from desheaving under rough treatment.

Another object of this invention is to provide an apparatus as above in which the hoisting sling can be safely and surely hooked up in place, whenever servicing as a concrete placer.

Another object of this invention is to provide an apparatus as above whose boom is foldable so as to be carried on a truck or the like.

In brief, this invention contemplates an apparatus for hoisting materials and placing concrete having a non-rotating mast and a boom which is swingable horizontally and vertically and consists of boom segments pin-jointed together in line so as to be foldable downwardly, a line of concrete transport piping which extends from the base end of the boom to the free end thereof, and a line of hoisting sling which extends from the base end to the free end, hangs down to hold a load handling block, rises up and extends back to the base end, each such line being supported alongside of the boom.

In service for hoisting materials, the boom is stretched and fixed at each pin-jointed connection between two adjacent boom segments by reciprocating pin-fastening means, whereas in service for placing concrete, the hoisting sling is raised up and seized in place along the boom. The apparatus is remotely controllable.

A primary advantage of this invention is that it can save space, time, labor and money, in virtue of having two functions as above.

Other objects and advantages of this invention will be readily appreciated as the apparatus becomes better understood by reference to the following detailed description when considered in connection with the accompanying drawings.

BRIEF DESCRIPTION OF THE DRAWINGS

Referring now to the drawings, wherein like reference characters designate like or corresponding parts throughout the several views.

DETAILED DESCRIPTION OF THE PREFERRED EMBODIMENT

Figure 2:
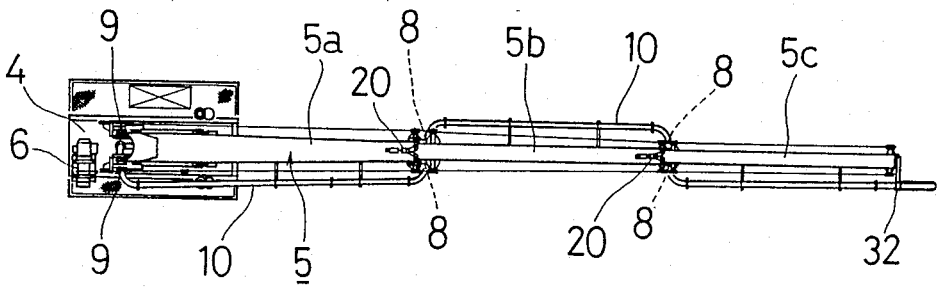
FIG. 2 is a plan view thereof.
Figure 1:
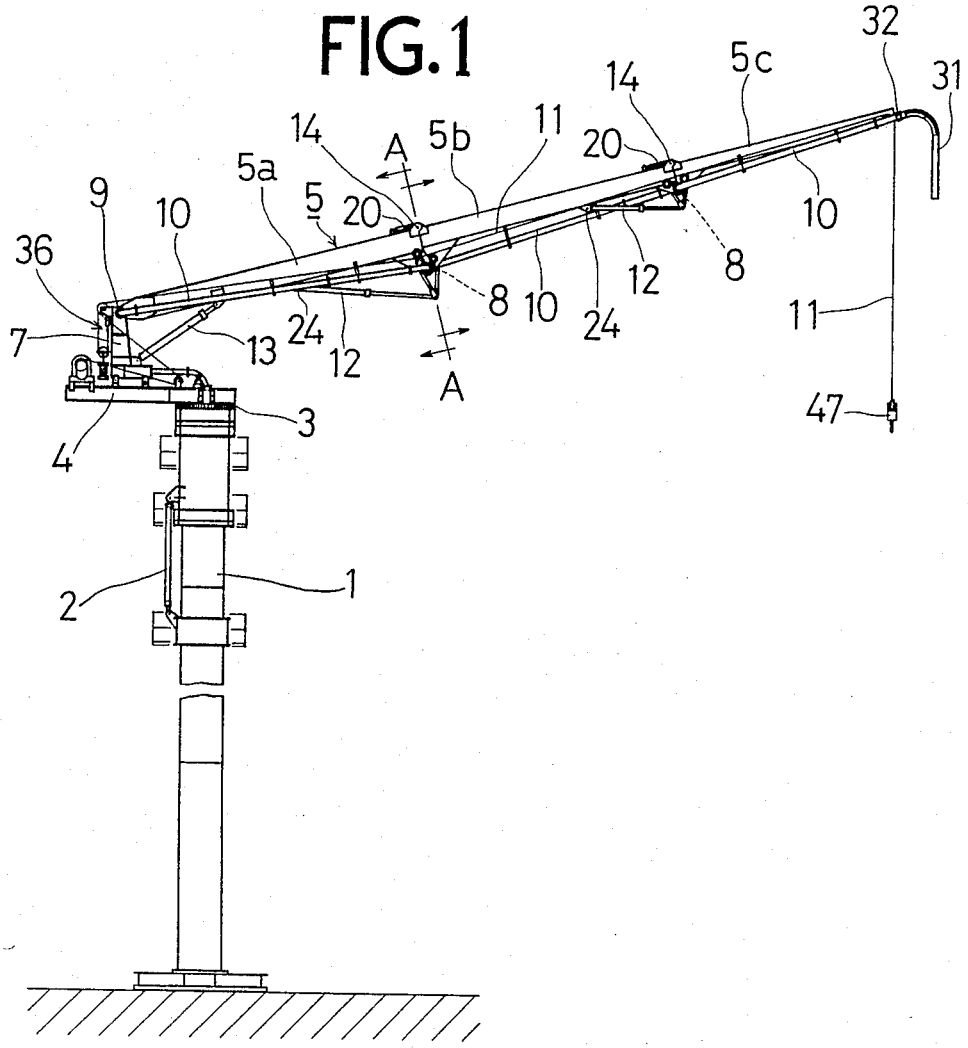
FIG. 1 is a front elevational view of a preferred embodiment of this invention.

Referring now to FIGS. 1 and 2, a non-rotating mast 1 having a self-sustained climbing device 2 around the periphery thereof, bears a carrier ring 3 at the top thereof, upon which a platform 4 is placed in a turnable relation to the mast axis in a full horizontal circle. A boom 5, a winch 6, and other ancillaries not shown in the drawings, such as a controller and a counterweight, may be mounted on the platform 4. As usual, the mounting of the boom 5 is interposed by a support frame 7 which locates at a suitable distance apart from the mast 1 so as to balance the weight acting on the mast. The boom 5 consists essentially of a plurality of, in the embodiment, three, segments 5*a*, 5*b*, and 5*c*, each of their cross sections forming a hollow rectangle reinforced partly from inside. The segments are pivotally interconnected in line so as to be only downwardly foldable, each such connection being fitted with a pair of pin-joints 8, 8 aligned laterally in line. The boom itself is connected pivotally to the supporting frame 7 by a pair of pin-joints 9, 9 again aligned laterally in line. Along the axial length of the boom 5, there are provided a line of fresh or fluid concrete transport piping 10, and a line of hoisting sling 11 in two rows of extending to the free end thereof and extending back to the base end thereof. Each pair of pin-joints 8, 8 is actuated by, in general, a power actuator, in the embodiment, a power cylinder 12, and the paired pin-joints 9, 9 are actuated by a pair of power cylinders 13, 13, respectively. The power cylinders are all worked by oil or water.

FIGS. 3, 4, 5 and 6 show details of connecting adjacent segments 5*a* and 5*b* by a pair of pin-joints 8, 8, fastening them by a pair of releasable reciprocating locking pins 14, 14, and actuating the connection by a power cylinder 12. Each pin-joint 8 is plane-symmetrical to the paired one, and is defined by a yoke bracket 15 which projects downward from the end of the segment 5*a* and is divided into two branches, and an eye bracket 16, and a hollow pivot pin 19, connected as is conventional in pin-jointing. The position of the pin-joints 8, 8 is lowered suitably below the segments, so as to embrace the third segment 5*c*, when the boom 5 is folded up, therebetween (see FIG. 7).

Figure 3:
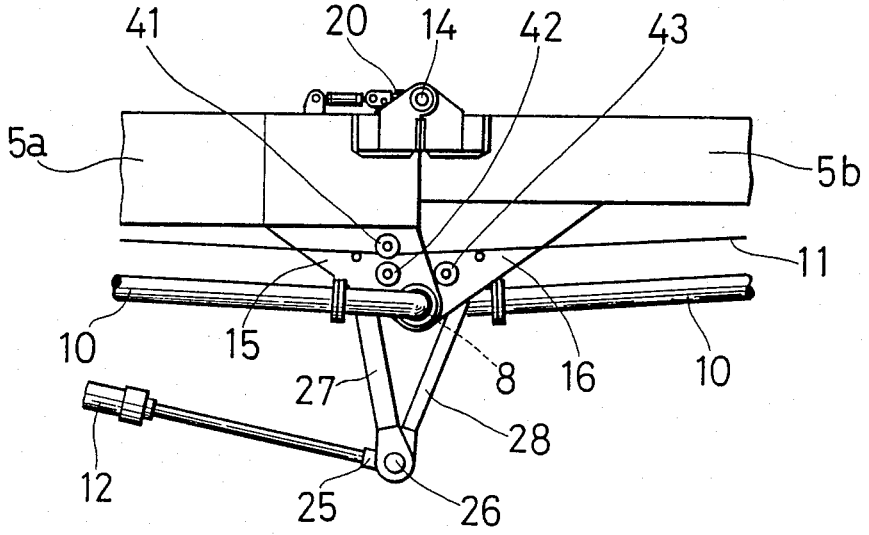
FIG. 3 is a fragmental elevational view showing two adjacent boom segments connected pivotally by a pair of pin-joints and further fastened releasably by a pair of reciprocating locking pins, and also showing how a concrete piping passes through the paired pin-joints.
Figure 6:
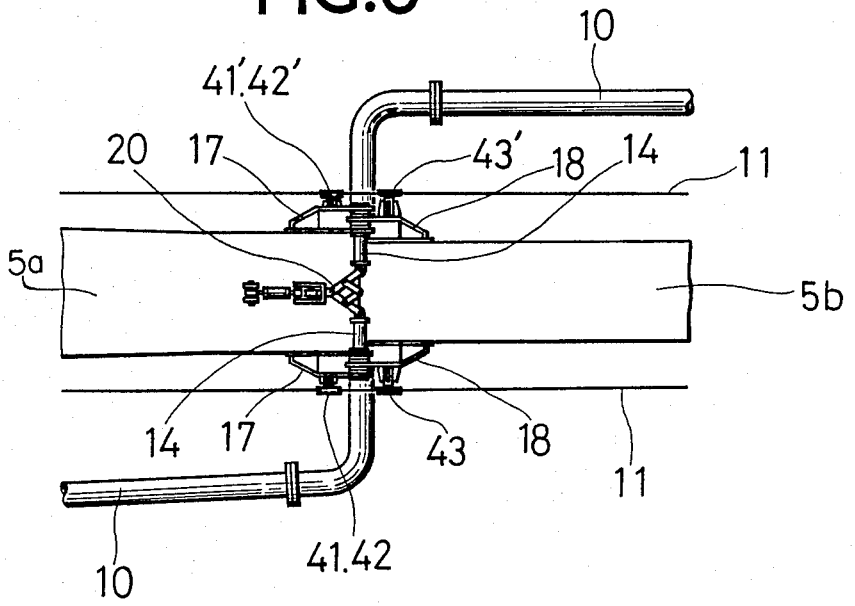
FIG. 6 is a fragmental plan view corresponding to FIG. 3.
Figure 9:
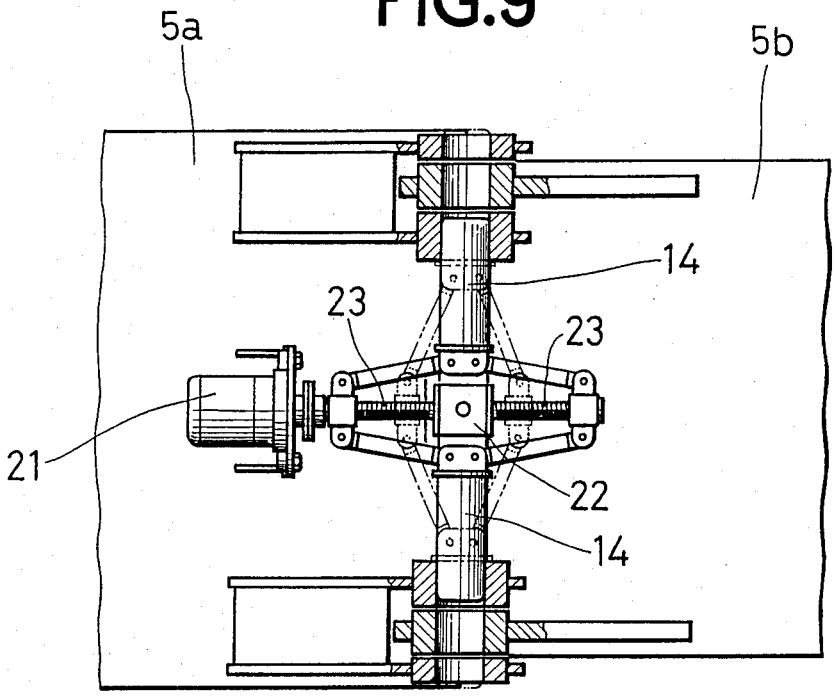
FIG. 9 is a plan view of an alternate actuator for the paired reciprocating locking pins, portions being shown in chain lines to indicate the actuating position.
Figure 10:
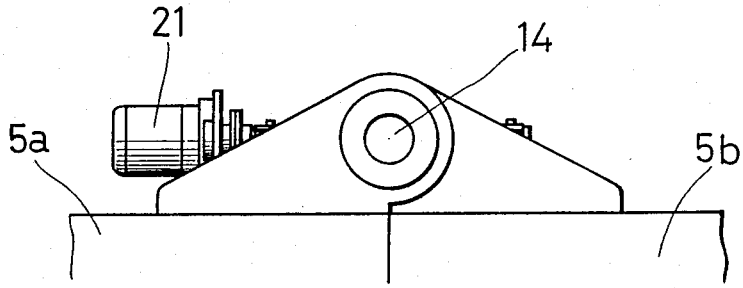
FIG. 10 is a side elevational view of the actuator shown in FIG. 9.

The opposing end faces of the segments are made to contact with each other, when the boom is stretched in line, in order to avoid upward bending. A pair of yoke brackets 17, 17, each having two branches 17′, 17′ projecting upward and each branch having a hole for pin fastening, are disposed sidewardly from either side of the end of the segment 5*a*, and a pair of eye brackets 18, 18, each having one branch 18′ which, in turn, has a hole for pin fastening, are disposed sidewardly from either side of the end of the segment 5*b*. Each pair of such yoke bracket branches embraces an opposing branch of each eye bracket when the boom 5 is stretched, so that all the three holes align in line. A pair of remotely controllable reciprocating locking pins 14, 14 actuated by an actuator 20 are provided near the end of the upper face of the segment 5*a*, as seen in FIGS. 3 and 6. Each locking pin fastens each corresponding set of brackets by forcing into the three holes registered with one another. The actuator just mentioned is a power cylinder, another potential actuator shown in FIGS. 9 and 10 being of a turn-buckle type, in which a hydraulic motor 21 drives a turn-buckle 22 and the movements of paired screwed members 23, 23 cause the movements of the paired locking pins 14, 14 located at right angles thereto. It will be apparent that these locking pins should be located suitably spaced apart above the boom 5 to better withstand against downward bending of the boom 5.

Figure 4:
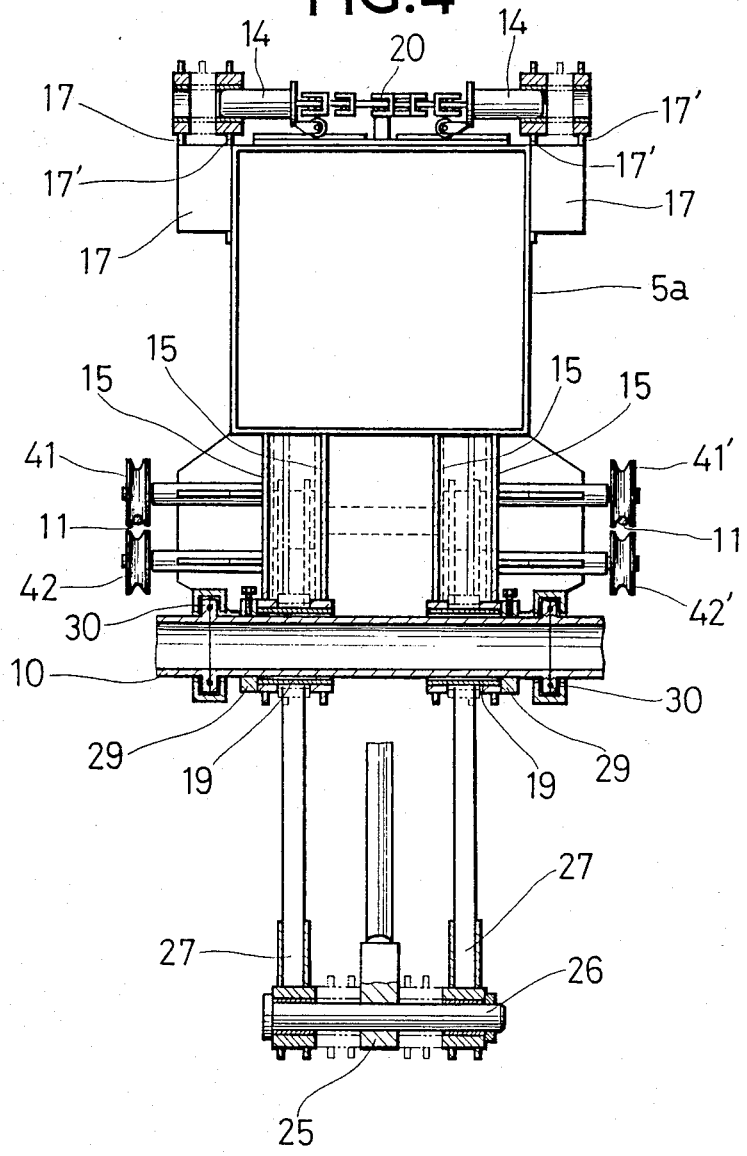
FIG. 4 is a cross sectional view taken on the line A—A of FIG. 1 and viewed to the left along the arrows.
Figure 5:
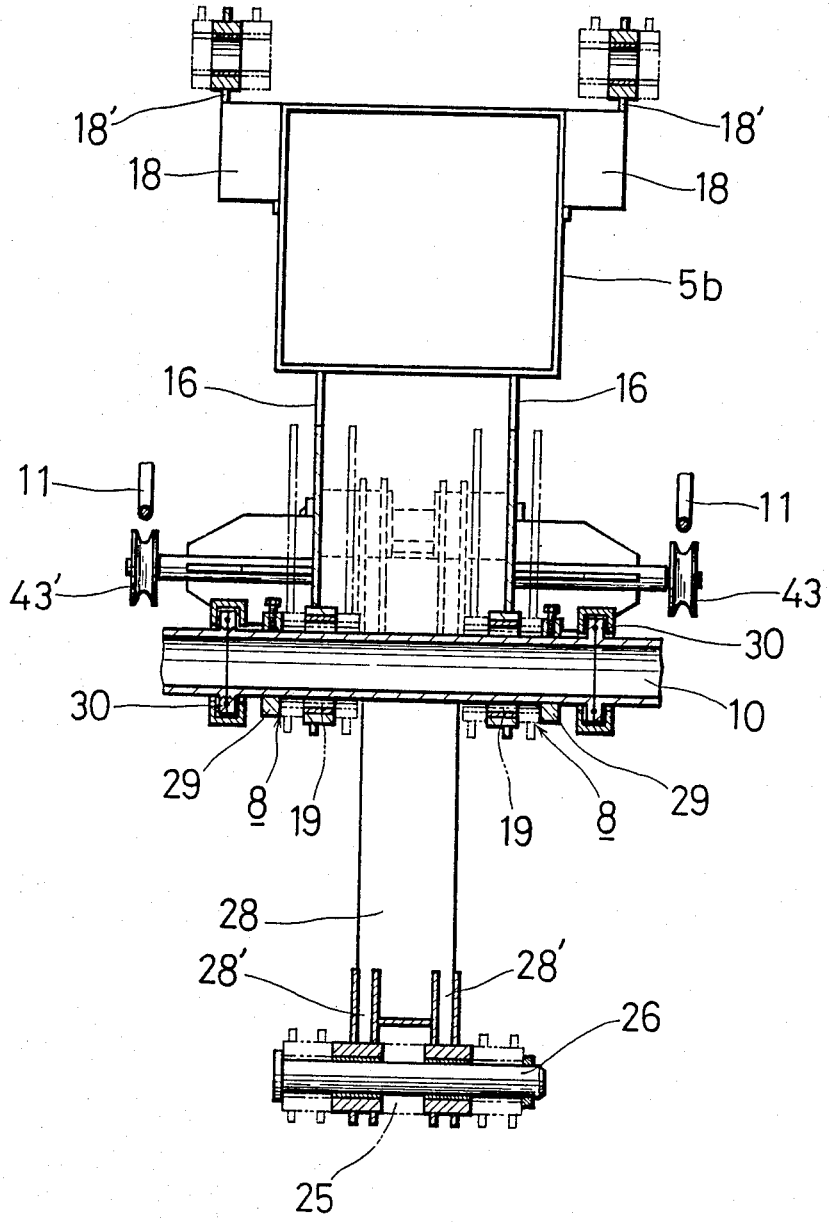
FIG. 5 is a like view as FIG. 4 taken on the same line A—A and viewed to the right along the arrows, the reciprocating locking pins and the actuator thereof being taken away.

The power cylinder 12 is located beneath the segment 5*a*, the cylinder-side end thereof being hinged to a bracket 24 which hangs down from a suitable axially intermediate and laterally central position of the segment (see FIG. 1). As seen in FIGS. 3, 4 and 5, the other end or piston-rod end 25 thereof is hinged to a pivot shaft 26 at the axially central part thereof, the pivot shaft 26, in turn, being hingedly connected to first two arms 27, 27 at the end parts thereof, and to a second arm 28, which is bifurcated to subarms 28′, 28′, at the axially intermediate parts thereof. Each of the other ends of the first arms 27, 27 is hinged to the bracket 15 in a suitable manner, whereas the other end of the second arm 28, is hinged to the bracket 16 in a similar way. The power cylinder 12, the first arms 27, 27 and the second arm 28, in cooperation, move the paired pin-joints of the adjacent segments.

Figure 7:
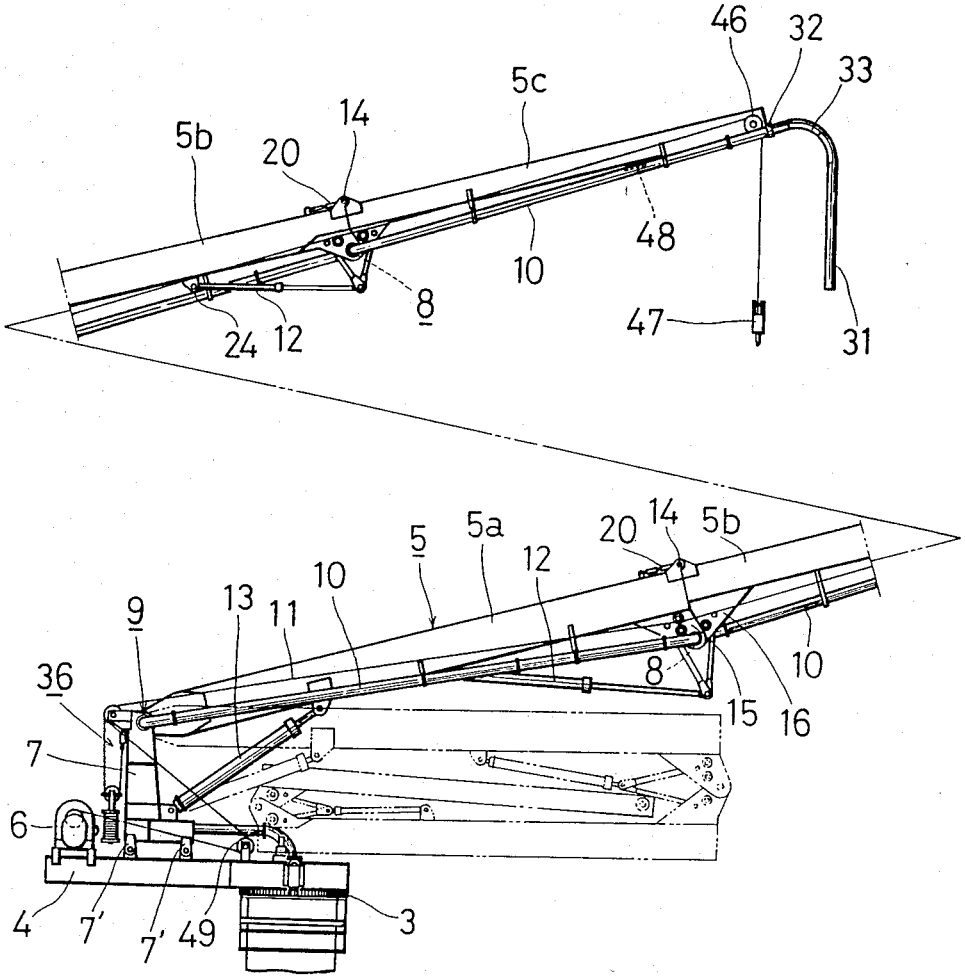
FIG. 7 is an enlarged front view of the integral part of the embodiment, in particular, showing how to use it in hoisting materials, and also showing, in chain lines, how the boom can be folded up one above another.

As best shown in FIG. 7, the boom 5 itself can be moved vertically by means of a pair of power cylinders 13, 13 at the base end thereof, each connecting, in parallel spaced relation, the supporting frame 7 and the segment 5*a*. In the figure, 7′ designates connecting members which releasably fasten the supporting frame 7 and the platform 4.

Figure 8:
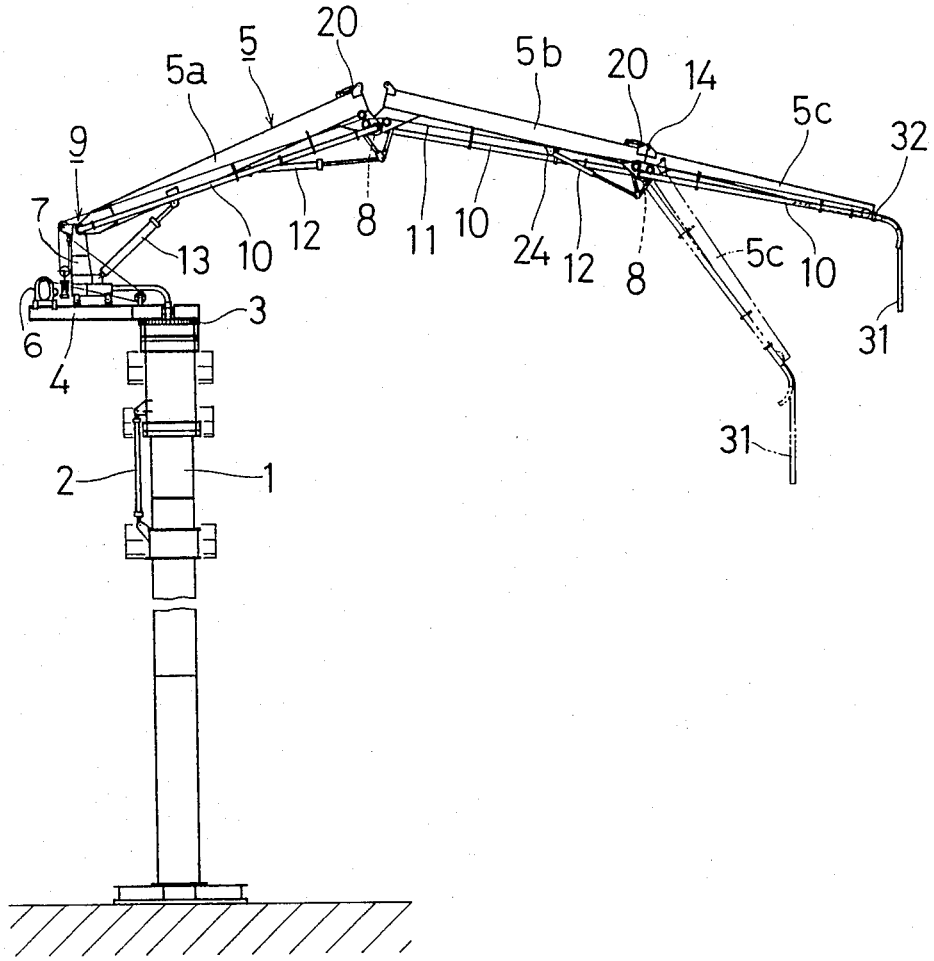
FIG. 8 is a front elevational view of the embodiment showing how to use it in placing concrete, portions being shown in chain lines to indicate a folded position of the free end segment of the boom.

The line of fresh concrete piping 10, although not shown explicitly in the drawings, starts from a concrete pump, climbs up inside of the mast 1, passes through the center well of the carrier ring 3, and appears at the top thereof. The pump may be placed at the ground level or on any suitable structure. As best seen in FIG. 7, the piping then creeps on the platform 4, and then goes up along the supporting frame 7. As was mentioned, the pivot pins used in each pair of pin-joints 8, 8 or 9, 9 are all made hollow, and the concrete piping 10 proceeds through the pin-joints 9, 9 across the segment 5*a*, extends along the axial length of the segment, reversely passes through the paired pin-joints 8, 8 across the boom 5, extends along the opposite side of the boom, and thus repeating, the square zigzagging, reaches the free end of the boom. As shown in FIGS. 4 and 5, the piping 10 is fixedly attached to each pin-joint by a flange 29 to avoid relative movement, and further, a rotary pipe coupling 30 is fitted to it to afford flexibility. As an alternative, the hollow pin per se can be used as a part of the piping, but the abrasion caused by concrete transportation requires frequent replacement thereof, and makes the means unattractive. As shown in FIGS. 1, 7 and 8, the concrete piping 10 is connected, at the free end of the boom 5, rotatably to a delivery hose 31, which may be made of rubber or the like, by the use of another rotary pipe coupling 32, the hose extending further on an arcuate supporter 33 which again is rotatable about the piping 10.

Figure 11:
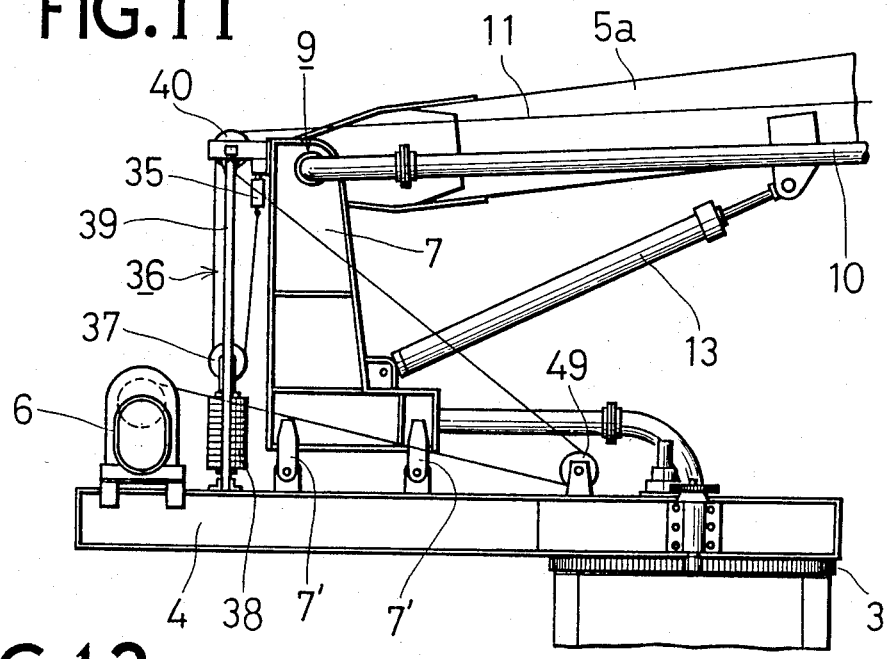
FIG. 11 is a front elevational view of a gravity actuated idler assembly.
Figure 12:
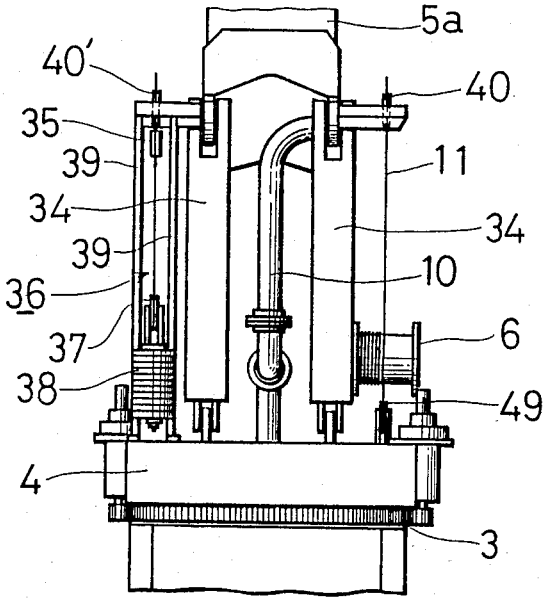
FIG. 12 is a side elevational view of the idler assembly shown in FIG. 11.
Figure 13:
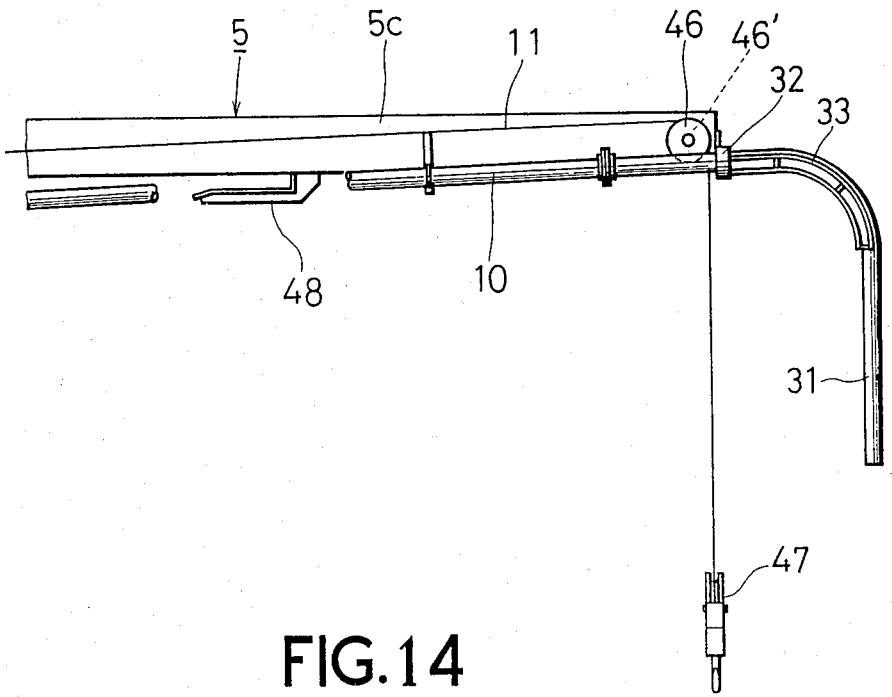
FIG. 13 is a side elevational view showing a hook provided beneath the free end segment of the boom.
Figure 14:
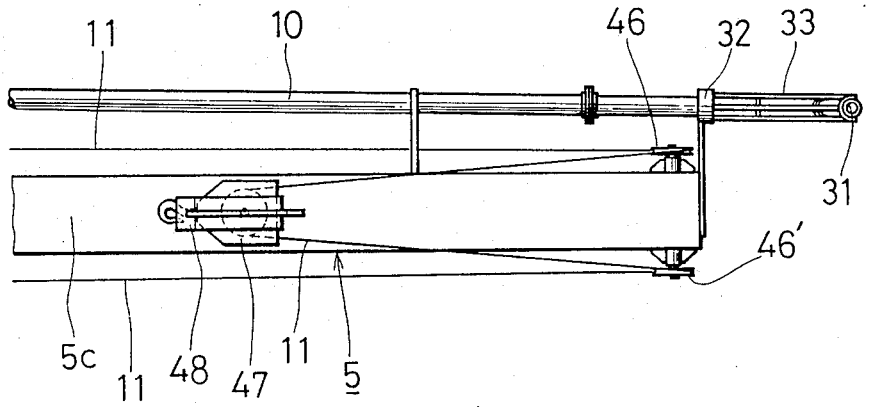
FIG. 14 is a rear plan view of the free end segment showing how the hook seizes a load handling block.

As seen in FIGS. 11 and 12, the line of hoisting sling 11 is fastened at one end thereof to one of the paired structures 34, 34 constituting the support frame 7. The sling then proceeds, via an overload limiting switch 35, to a gravity actuated idler assembly 36, which includes an idler sheave 37, piled weights 38 having a circular cross section and a pair of symmetrically spaced recesses at the periphery thereof and hanging down from the sheave, and a pair of guide supports 39, 39 to engage the recesses. This assembly has been proven most stable and reliable against sudden and frequent slack caused by the operation of the boom 5. The sling further extends through a sheave 40' seen in the figures, passing through sheaves 41', 42', 43', 44', and 45' along the rear side of the boom as seen in FIGS. 1 to 7, to a sheave 46' located at the free end thereof. The sheaves 41' and 42' support the sling from above and below respectively, so as to prevent desheaving. As seen in FIGS. 13 and 14, the sling hangs down after passing around the sheave 46', holds a load handling block 47, and goes up to a sheave 46 which locates at the front side of the boom 5. Notice that sheaves which locate at the rear side are designated by "'" notations in distinction from the paired one at the front side. As seen in the figures, the free end segment 5c has a hook 48 projected downward at the bottom face thereof, which acts to seize the load handling block 47 when the apparatus is used for concrete placing with the block 47 raised up. To enable this, the boom 5 is swung up upright such that the block 47 hangs down by gravity just below the hook 48, whereafter the sling 11 is wound up until the hook seizes the block in place. It will be apparent that, to this end, the position of the sheaves 46, 46' should be made suitably higher than the hook 48, with the assumption that the boom 5 lies horizontally. The sling 11 thence extends back, passing through sheaves 45, 44, 43, 42, 41 and further passes through a sheave 49 mounted on the platform 4, and is eventually wound up controllably by the winch 6. The manner of fixing the shaft of each sheave to the respective segment is best shown in FIGS. 4 and 5.

As shown particularly in FIGS. 1, 2, and 7, the position of the sling 11 at which it hangs down to hold the load handling block and rises up, and that of the concrete pipe 10 connected to the delivery hose 31, both of them locating around the free end of the boom 5, should be sufficiently spaced apart to avoid interference with each other.

The apparatus of the embodiment has an electrical control means which prevents simultaneous functioning as load hoisting and concrete placing, such that when the boom segments are fastened by the reciprocating locking pins, the winch 6 does work, whereas when the locking pins are released, the winch does not work.

It is a matter of course that each power cylinder can be independently operable by a suitable controller or controllers remotely set up, for example on the platform 4, except for the paired cylinders 13, 13 which must work substantially identically.

As is conceivable from FIG. 8, the apparatus can take practically infinite variety of configurations with regard to the folded boom when used as a concrete placer, and by virtue of this versatility, the delivery hose 31 can deeply immerse into wall shatterings or the like down to the bottom without free fall and segregation of concrete.

The climbing device 2 mounted around the mast 1 enables the mast to be separated into sections which can be detachably connected. Therefore, the triply folded-up boom and the sections of the mast can be carried on the truck or the like from a job site to another.

It is to be understood that the form of our invention herein shown and described is to be taken as a preferred example of the same and that various changes in the shape, size and arrangement of parts may be resorted to without departing from the spirit of our invention or scope of the subjoined claims.

What we claim is:

1. An apparatus for hoisting materials and for placing concrete which comprises:

(a) a non-rotating mast;

(b) a platform mounted at the top of said mast by a rotary connection which comprises means for swinging said platform about said mast axis;

(c) a support frame attached to said platform;

(d) a hoisting winch secured to said platform;

(e) a pin-jointed boom which is attached to said supporting frame in vertically swingable fashion, said boom having a base end and a free end and being foldable only downwardly at said pin joints and comprising a plurality of segments which are pin-jointed in a line, each pin joint including a pair of brackets which project downwardly from ends of adjacent segments;

(f) a line of concrete transport piping which begins at a concrete pump, and then extends alongside the boom from the base end of said boom, through successive pin joints in a substantially zig-zag configuration, towards the free end of said boom, and which terminates in a discharge end which hangs downwardly from said free boom end;

(g) a line of hoisting sling attached at one end to said support frame and extending alongside of said boom from said base end of said boom to a free end of said boom, said hoisting sling hanging downwardly to hold a load-handling block, then extending upwardly and rearwardly back to said base end of said boom, said hoisting sling being wound by said hoisting winch;

(h) means for releasably locking pairs of adjacent boom segments in line in order to strengthen said boom when said boom is used to hoist materials, said locking means being located in spaced, fixed relation above an upper surface of the boom;

(i) at least one sheave comprising means for guiding said hoisting sling line, said sheave projecting outwardly in spaced relation from a respective downwardly projecting bracket at the end of said boom segment, a lower surface of the boom segment which is located at said free boom end having a hook located substantially at a central portion of said lower surface, said hook comprising means for grabbing said load handling block when said apparatus is used as a concrete placer.

2. An apparatus for hoisting materials and placing concrete in accordance with claim 1 wherein said locking means comprises a yoke bracket which projects upwardly from one boom segment in each pair of adjacent boom segments, an eye bracket projecting upwardly from the other boom segment in each pair of adjacent boom segments, and a reciprocating pin which is adapted to fasten said yoke bracket to said eye bracket.

3. An apparatus for hoisting materials and placing concrete in accordance with claim 1 further comprising a gravity-activated idler sheave assembly which comprises an idler sheave, piled weights hanging downwardly from said sheave which each have a circular cross-section and a pair of recesses located at the periphery of said weights, and a pair of guide supports for engaging said recesses.

4. An apparatus for hoisting materials and placing concrete in accordance with claim 1 wherein said concrete piping extends through each of said pin joints, each of said pin joints being hollow.

* * * * *